US006929055B2

(12) United States Patent
Kunstreich et al.

(10) Patent No.: US 6,929,055 B2
(45) Date of Patent: Aug. 16, 2005

(54) EQUIPMENT FOR SUPPLYING MOLTEN METAL TO A CONTINUOUS CASTING INGOT MOULD

(75) Inventors: Siebo Kunstreich, Saint Ouen (FR); Marie-Claude Nove, Paris (FR)

(73) Assignee: Rotelec, Bagnolet (FR)

( * ) Notice: Subject to any disclaimer, the term of this patent is extended or adjusted under 35 U.S.C. 154(b) by 135 days.

(21) Appl. No.: 10/673,171

(22) Filed: Sep. 30, 2003

(65) Prior Publication Data

US 2004/0112567 A1 Jun. 17, 2004

Related U.S. Application Data

(62) Division of application No. 10/149,388, filed as application No. PCT/FR01/00263 on Jan. 29, 2001, now abandoned.

(30) Foreign Application Priority Data

Feb. 29, 2000 (FR) ..... 00 02501

(51) Int. Cl.[7] ..... B22D 11/00; B22D 27/02
(52) U.S. Cl. ..... 164/502; 164/466
(58) Field of Search ..... 164/466–468, 164/502–504

(56) References Cited

U.S. PATENT DOCUMENTS 5,279,351 A 1/1994 Metz
5,632,324 A 5/1997 Nara et al.
5,746,268 A 5/1998 Fujisaki et al.

FOREIGN PATENT DOCUMENTS

| | | |
|---|---|---|
| EP | 0321 206 | 6/1989 |
| EP | 0 685 282 | 12/1995 |
| JP | 08-257692 | 2/1997 |
| JP | 9-285852 | 11/1997 |
| JP | 11-197807 | 10/1999 |
| WO | 92/12814 | 8/1992 |

*Primary Examiner*—Kuang Y. Lin
(74) *Attorney, Agent, or Firm*—Young & Thompson

(57) ABSTRACT

The apparatus comprises a submerged entry nozzle (6) having outlets in the main casting plane (P) which differ in their direction of output and fall within two categories (7, 8). The nozzle is associated with two inductors (14, 15) opposite each other on each broad face (22) of the casting mold forming a gap which surrounds the nozzle and produces a traversing magnetic field covering the outlets of at least one category (7). Elements are provided for adjusting the intensity of the field or for moving it so as to be able to change the distribution between the outlets of the total flow of molten metal. Implementing the invention makes it possible to adjust at any time that fraction of the metal flow which is directed toward the free surface (9) with respect to that, main, fraction directed toward the bottom of the mold.

11 Claims, 3 Drawing Sheets

(Section R-R)

(Section Q-Q)

EQUIPMENT FOR SUPPLYING MOLTEN METAL TO A CONTINUOUS CASTING INGOT MOULD

CROSS REFERENCE TO RELATED APPLICATION

This is a Continuation-In-Part of parent application Ser. No. 10/149,388 filed on Jun. 12, 2002 now abandoned, as the 35 USC 371 National Stage of International Application PCT/FR01/00263 filed on Jan. 29, 2001, which designated the United States of America.

BACKGROUND OF THE INVENTION

The present invention relates to the continuous casting of metals, especially steel. It relates more particularly to the supply of molten metal from above into a continuous casting mold and even more specifically to the techniques using magnetic fields applied to the mold in order to modify the flows of molten metal as it enters the mold.

DESCRIPTION OF THE PRIOR ART

It is known that applying a magnetic field to a continuous casting mold, when the electromagnetic action is performed in a suitable manner, makes it possible to increase the productivity of the casting plant while still maintaining the metallurgical quality of the cast products obtained, or even improving it. In this regard, it has already been demonstrated that, when the casting rate is increased, especially in the case of casting products of elongate cross section, such as slabs, the hydrodynamic turbulence due to recirculating flows which become established with increasing strength within the mold is a nuisance.

It will be recalled that, in the continuous casting of slabs, the molten metal is fed into the mold from a tundish placed at a certain distance above it via a dip pipe, called a "submerged entry nozzle", the outlets of which open substantially in the main casting plane parallel to the broad faces below the free surface of the molten steel in the mold, said surface being conventionally covered with a liquid layer of active slag.

It has been established that the velocity of the streams of liquid metal leaving the outlets of the nozzle increases to several meters per second as soon as the casting speed reaches about 1 to 1.5 m/min. The recirculating flows in the mold which result therefrom vigorously stir the metal/slag interface. These fluctuations in the free surface of the cast metal are responsible for irregularities in the solidification of the initial shell of the cast product which is known to be the source of problematic, or indeed unacceptable, defects in the final product (blistering, exfoliation, etc.). In addition, fragments of covering slag may be taken away in the mold into the very core of the cast product, thus degrading the cleanliness of the solidified metal obtained.

Faced with the problem posed by these hydrodynamic perturbations, a steelmaker today has at his disposal essentially two types of solution, one making use of the available magnetohydrodynamic tools suitable for the continuous casting of metals and the other relying on the actual geometry of the casting nozzle.

The electromagnetic actuators that have been developed for this purpose, whether with a static or traveling magnetic field, have an influence on the recirculating flows of liquid metal in the mold after it has left the nozzle, so as to brake or accelerate them, or to make them symmetrical on either side of a submerged entry nozzle.

Thus, electromagnetic brakes were originally developed that consisted in applying, at a predetermined height level in the internal space of the mold, a traversing magnetic field which creates braking forces (Laplace forces) in the moving metal when it passes through this region. For this purpose, it has been proposed to use, on each broad face of the mold, a magnetic pole, designed like a coiled salient-pole electromagnet, having the shape either of a protrusion located on each side of the nozzle between the latter and the narrow end faces of the mold (EP-A-0040383), or a horizontal bar extending over the entire width of the broad face (WO 92/12814) or of two parallel bars spaced apart over the height so as to flank the outlets of the nozzle (WO 96/26029 and WO 98/53936). Whatever the geometry adopted, the aim is the same: on the one hand, to create, with the like pole of opposite sign placed opposite it on the other face of the mold, a traversing magnetic field whose effect is to brake the excessively energetic streams which rise toward the free surface and, on the other hand, to better distribute over the entire cross section of the mold the main stream of liquid metal which flows downward.

In order to achieve with this type of technique greater control flexibility, it has been proposed to use magnetic fields that are no longer static but traveling, it being known that these have the ability to entrain liquid metal in their movement (EP-A-0 151 648, WO 83/02079 and JP-B-1 534 702). Two inductors with a horizontally traveling field (vertically oriented conductors) are placed on each broad face of the mold on each side of a submerged entry nozzle having lateral outlets, between the nozzle and the narrow end faces so as to make the traveling magnetic field intercept the molten metal as soon as it enters these regions of the mold. Thus, it is possible to accelerate (or to brake, depending on the direction of relative movement given to the traveling field) the streams of liquid metal feeding the mold by having the ability to locally control the electromagnetic action by simply adjusting the operating parameters of the inductors, such as, for example, the intensity of the primary supply electric current, or the angular frequency, and hence the speed of travel of the magnetic field.

It will be recalled if required that such a traveling magnetic field is generally produced by an inductor having several independent phase windings, of the "polyphase linear motor stator" type (generally two-phase or three-phase type) and that this is placed opposite a broad face of the mold, and therefore parallel to the main casting plane (FR-A-2,324,395 and FR-A-2,324,397). Each winding is connected to a different phase of a polyphase electrical supply, in a suitable connection order ensuring that the magnetic field travels in the desired manner along the active face of the inductor in a direction perpendicular to the conductors.

It has also already been proposed, for the purpose this time of counteracting the observed phenomena of wave propagation on the free surface from one narrow face of the mold to the other, to improve the symmetry of the flows of molten metal entering the mold in the regions on each side of the nozzle by means of a movable magnetic pole, the position of which can be adjusted mechanically, or of two adjacent fixed magnetic poles which are intercorrelated in their respective actions on the moving metal (EP-A-0,832,704 and JP-A-03275256).

The other type of solution consists in optimizing the geometry of the submerged part of the teeming nozzles, especially the outlets for the molten metal. The aim is always the same, namely to control the distribution of the flows of liquid metal entering the mold.

For example, this type of solution includes nozzles of the "box" type (U.S. Pat. No. 464,698 [lacuna] and JP-A-63, 76753), the submerged part of which has an overall bulbous shape reminiscent of a decorator's brush or of a flattened sprayhead, the function of which is assumed moreover to be similar.

These nozzles are quite extensively open toward the bottom in order to favor outflow in the main casting plane of the casting streams with a low velocity but over a large flow section. Their main property is thus to try to deliver liquid metal to the mold with a uniform flow, approaching the ideal flow called "plug" flow, in which the velocity gradient between any two points of a cross section is close to zero and said section rapidly becomes as close as possible to that of the mold. These box-shaped nozzles are starting to be widely used in the industry, especially on thin-slab continuous casting plants. The recirculating streams of metal flowing toward the free surface of the cast metal may thus be highly attenuated, to such a point that it might be possible to provide, where appropriate, additional openings at the top of the box or along the side in order to allow streams of molten metal to flow out upward in order to provide an additional uniform supply of heat to the free surface, which it is known is necessary for the casting to proceed properly.

Also within this type of solution are straight nozzles having two different pairs of lateral outlets which are oriented in the main casting plane, parallel to the broad faces of the mold. Outlets placed in the bottom position on the shaft of the nozzle deliver, generally in a downward direction, the primary stream of metal to be withdrawn from the mold. The other outlets are arranged in the top part so as to deliver a secondary stream intended to supply the free surface with heat via a uniform but low-flowrate supply of "fresh" molten metal that has only just entered the mold, and therefore with a high enthalpy. The relatively low manufacturing cost of this type of nozzle may be a significant economic advantage in the case of wear components of this kind, which have to be regularly replaced.

That being so, whatever the conformation used for the nozzle-straight or box-shaped, it is necessarily fixed in its geometry and therefore can be optimized only for a single method of carrying out the casting operation, or for a particular shape of cast product. This type of approach therefore seems to be ill-suited to the inevitable operating variations or modifications, whether unintentional or intentional, specific to modem continuous casters, such as variations in the casting speed, changes in product shape, etc.

Electromagnetic actuators (brakes, accelerators symmetrizers) are by nature more flexible to use, and therefore more appropriate for following such variations. However, they are not optimized for any particular operating mode. They control the flows of liquid metal once it has entered the mold and then act sometimes as an accelerator and sometimes as a flow brake. However, they absolutely do not have the capability, unlike certain of the abovementioned nozzles, to distribute the inflow of molten metal between the top region of the mold (toward the free surface) and the bottom (in the direction of extraction of the cast product). Furthermore, they are relatively expensive in terms of investment cost and in cost of electrical energy consumption, and they involve complex and financially burdensome modifications in the technology of the molds which receive them.

SUMMARY OF THE INVENTION

The object of the present invention is specifically to provide steelmakers with a tool of feeding a continuous casting mold with molten metal, which readily allows rapid and precise control of the incoming metal flow distribution between the top and bottom regions of the mold.

With this objective in mind, the subject of the invention is an equipment for supplying a mold of a plant for the continuous casting of products of rectangular cross section, such as slabs, with molten metal, which comprises:

a submerged entry nozzle provided with outlets for the molten metal which lie in, or substantially in, the main casting plane parallel to the broad faces of the mold, these outlets differing in their direction of outflow and falling within at least two separate types;

an inductive unit placed over the broad faces of the mold in order to produce thereon magnetic poles of opposite sign facing each other on each side of said main casting plane and delivering, in its gap substantially surrounding the nozzle, a traversing magnetic field covering the outlets of at least one of said types; and means for adjusting the relative intensity of said magnetic field, in the region of the outlets of said type covered which is, with respect to the outlets of the other type, so as to be able to modify the distribution of the total flow of molten metal between all the outlets of said nozzle.

According to one embodiment, said inductive unit is an electromagnetic unit consisting of at least one electromagnet.

According to another embodiment, said inductive unit consists of inductors having a plurality of phase windings of the "traveling field" type, facing each other on each side of said main casting plane, and of an associated electrical power supply which supplies each of said windings separately with DC current, and the means for adjusting the relative intensity of the magnetic field comprise means for moving the location of the magnetic poles in the gap of said electromagnetic unit.

It is conceivable to use an inductor (an electromagnet or an inductor of the "traveling field" type) only on a single face of the mold, but to the detriment in this case of the electromagnetic power available. In any case, according to the invention, the magnetic pole of the inductor must always deliver a magnetic field directed perpendicular to the wall of the mold opposite which the inductor is mounted. Otherwise, the desired effect is not obtained. Thus, if two inductors are face to face, the facing magnetic poles are of opposite sign so as to create a traveling magnetic field, that is to say the lines of force of which field link the two poles by extending perpendicular to the main casting plane in which the streams of metal are created through the outlets of the nozzle placed in the gap between the two inductors.

A magnetic pole of an inductor is defined as the region of the active face of the inductor where the magnetic field produced is a maximum. In the case of an electromagnet, the pole is the end, often projecting, of the wound ferromagnetic metal body which characterizes the device. In the case of an inductor of the traveling-field type with a plurality of phase windings, the magnetic pole does not have a fixed physical representation attached to a given ferromagnetic body of the yoke, but it can move over the active face of the inductor according to the instantaneous intensity of the AC phase currents which supply the conductors and according to their phase difference. Likewise, it may be said that a magnetic field "covers" the nozzle outlets, when the latter lie in a region of space within the mold where the magnetic induction produced by this field is a maximum.

Having been given these details, it will be understood that it is easy to modify the action of the magnetic field in that region of the nozzle outlets which is covered by this field, according to the invention (relative to the possible action exerted in the region of the other outlets) by suitably adjusting the intensity of this field in the region in question. This action is achieved either by varying (decreasing or increasing) the intensity of the magnetic field, without modifying the position of the magnetic pole which delivers it, or by modifying the position of the magnetic pole on the broad faces of the mold while maintaining its intensity. The first operating version mentioned above may be preferred if, with respect to the size and to the distance of the magnetic pole used, the outlets of the two types are quite far apart on the body of the nozzle so that the values of the magnetic induction in their respective regions may be very different, while the intensity of the field is a maximum, for example, over the outlets covered by this field. On the other hand, the second version mentioned above is better suited to the case, which is doubtless inevitably the most frequent, in which all the outlets are covered and in which only the movement of the pole can provide a field differential between them which is sufficient to obtain, in a pronounced manner, the results desired by the invention.

Of course, in the case of an electromagnet the movement of the magnetic pole will be obtained by mounting the electromagnet so as to be able to move on a frame fastened to the caster and provided with means which make it possible to move it over that face of the mold on which it is mounted and to stop it at the chosen site.

It is also possible in some cases to benefit by dividing the inductor into two inductive parts placed side by side along the same face of the mold, each part thus controlling the outlets lying on one side of the nozzle, independently of those lying on the other side.

Whatever the embodiment used, it will doubtlessly already have been understood that a basic idea of the invention consists in using a magnetic field as a kind of nonphysical valve for closing off the passage provided by one type of nozzle outlet so as to modify the outflow from the other type of outlet. Since the feed rate to the nozzle is constant, or in any case hardly affected by the action of the magnetic field, this action, which acts directly at one type of outlet, will have the effect of modifying the distribution of the fractions of the total flow between the two types of outlet. What is produced is a kind of submerged entry nozzle whose geometry can be varied without modifying its shape.

Preferably, the main outlets, namely those from which the outflow of molten metal is the greatest, (those generally directed downward) will be covered by the magnetic field since the variations in the action of this field on the outflows will be more appreciable therein than on those where the flow of metal is smaller. In the rest of the description, it will be assumed for the sake of clarity that the magnetic field covers the main downwardly directed outlets.

However, it will be noted that the main exit of the nozzle directed downwardly can be obtained by single and individual outlet.

It will also have been understood that, in a preferred embodiment, the invention uses a traversing magnetic field which can move vertically in the nozzle region but is produced by a fixed inductive unit: a pair of inductors facing each other, each of the "linear motor stator with a traveling magnetic field" type, which are matched so that the inductors are in phase opposition and each of them can produce a magnetic field whose lines of force are oriented in the same direction (the condition specific to obtaining a so-called "traversing" magnetic field), but the phase windings of which are connected to individual DC power supplies that can be adjusted independently of each other. Such an inductive unit is then capable, as is known, of generating magnetic poles of opposite sign, and therefore a traversing static magnetic field, which can be located at the desired point in the gap. This change in the position of the poles is obtained by selectively activating the windings of the inductor by simply adjusting the operating parameters of the individual power supplies, namely, in practice, the intensity of the electric currents which they deliver. These adjustments can be made instantly, during the actual casting if so desired, remotely from the caster, completely safely for the operators, and in a completely transparent manner, that is to say without any risk, even minute, of disturbing the proper execution of the casting operation. It will be recalled that the structure of this type of inductor has been known for a long time as has indeed its use in continuous slab casting as a means of moving the molten metal over the height of the mold (cf. for example the abovementioned patents FR-A-2,324,395 and FR-A-2,324,397).

Thus, the subject of the invention is also a process for operating the preferred apparatus defined above, the process consisting in adjusting the intensity of the magnetic field either by moving the position of the poles of the inductive unit or by modifying the intensity of the electric current supplying the inductive unit.

BRIEF DESCRIPTION OF THE DRAWINGS

The invention will be fully understood and further aspects and advantages will become more clearly apparent in the light of the description which follows, given solely by way of illustrative nonlimiting example with reference to the appended plates of drawings, in which.

In these figures, the same components are denoted by identical reference numbers.

DESCRIPTION OF THE PREFERRED EMBODIMENTS

Figures 1, 2:
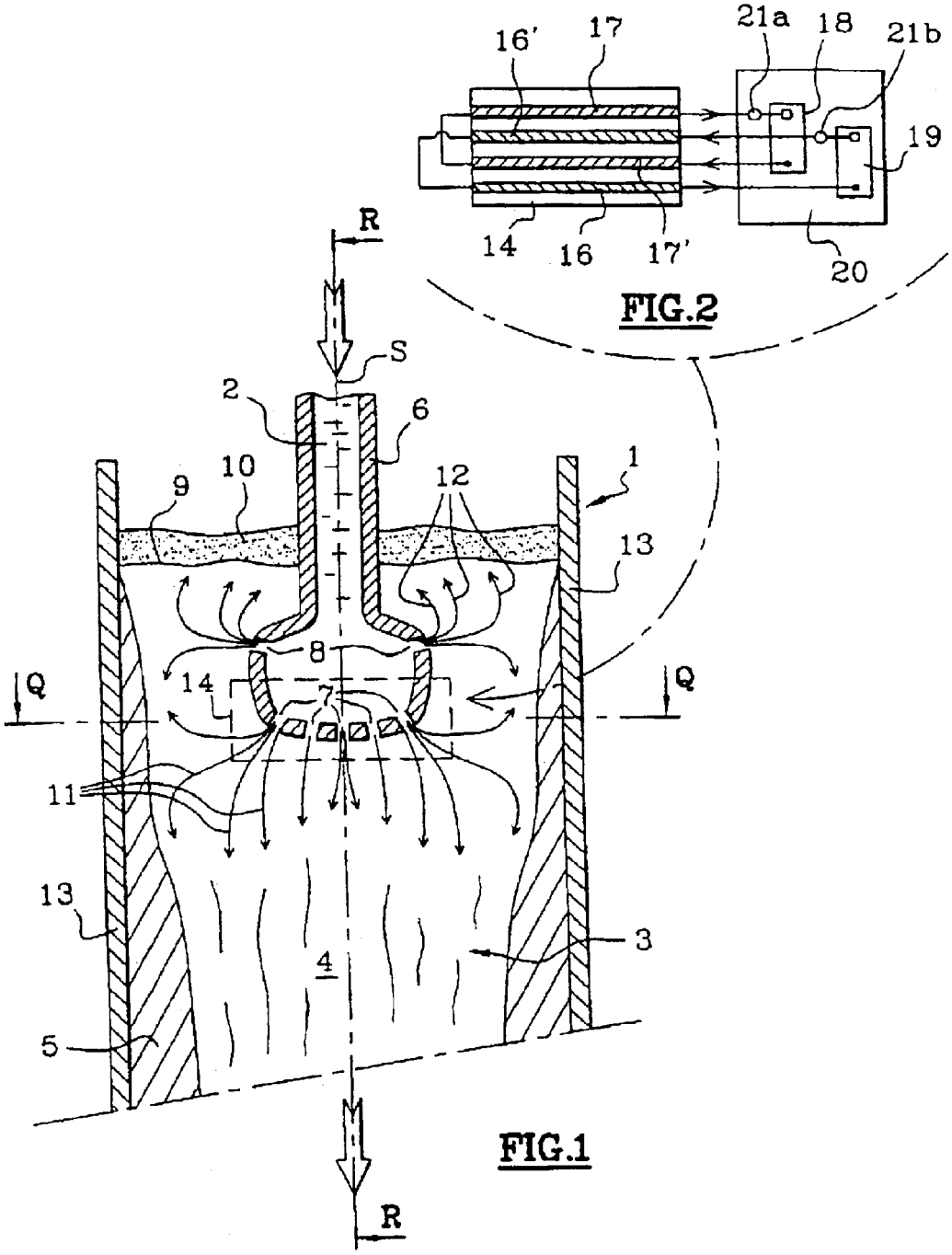
FIG. 1 shows schematically, seen from the front, in vertical section in the main casting plane, a mold for the continuous casting of steel slabs provided in its upper part with an apparatus for feeding molten metal in accordance with the invention in an embodiment with a single inductor per mold face.
FIG. 2, as a vignette of FIG. 1, is a diagram explaining the structure of a flat inductor of known type which may be suitable for implementing the invention and linked for this purpose to a DC electrical power supply.

A mold 1, made of copper or a copper alloy and vigorously cooled by a circulation of water around its external wall, receives, from the top, a certain flow of molten metal 2 which it withdraws downward in the form of a semifinished iron or steel product 3, which will be assumed here to be a steel slab. On leaving the mold, the slab 3, still liquid in the core 4 but already solidified around the periphery 5 as a result of it coming into contact with the cooled internal wall of the mold, completes its solidification as it advances along the casting axis S through the lower stages of the casting plant, especially by water being sprayed directly onto its surface. The influx of "fresh" metal into the mold takes place via a submerged entry nozzle 6 whose upper part, not visible in the figure, is fixed around a taphole made in the bottom of a tundish placed at a certain distance above it and whose bottom part is immersed in the mold. This lower part comprises outlets 7, 8 opening out below the free surface 9 of the liquid metal covered by a blanket 10 of cover slag. As may be seen, these outlets, oriented in the main casting plane, are of two different types:

main outlets 7 inclined downward and delivering the major part of the flow of steel feeding the mold by means of streams 11 in an overall direction lying in the main casting plane (the plane of the figure) and generally going toward the bottom of the mold;

secondary outlets 8 lying above, inclined upward and delivering, somewhat in the direction of the side faces 13 of the mold, the rest of the flow of metal by means of streams 12 taking to the surface 9 an influx of heat needed to prevent parasitic solidification phenomena on the meniscus (solidification hooks, etc.).

The reader is reminded that the expression "main casting plane" is understood to mean the vertical mid-plane P passing through the casting axis S at the center of the mold and parallel to the broad faces 22 of the latter. In this case, FIGS. 1 and 5 lie precisely in the main casting plane P. The other plane, analogous but parallel to the narrow side faces 13 of the mold, is termed the secondary casting plane. FIGS. 3*a* and 3*b* are in the secondary casting plane.

The law of conservation of "matter" flow means, of course, the flow of metal withdrawn via the bottom of the mold is equal to the flow of metal, entirely liquid, entering the mold via the nozzle 6. Since the speed of withdrawal V is a casting parameter, it is this speed which, for a given cross section of product 3, determines the incoming flowrate and hence the rate of outflow of liquid metal from the nozzle outlets. As already stated, if the casting plant is a high-productivity plant (speed of withdrawal V threshold of about 1.5 m/min), the recirculating streams, which are inevitably set up in the mold because of the magnitude of the difference between the speed of extraction and the speed, a hundred times greater, of the streams of metal output by the nozzle outlets, quickly become very vigorous. Violent and turbulent recirculation loops, doped by the reflections of the streams of metal off the narrow faces 13 of the mold, therefore greatly disturb the free surface 9. These disturbances are deleterious and must be attenuated, or indeed eliminated. However, this attenuation must not prejudice the heat influx to the free surface 9 carried by the secondary streams 12. Since the operating regime of a continuous caster is above all of the "transient" type, especially because of the variations in the casting speed, this desired balance between the need for a flat and calm free surface and for a free surface heated by the "fresh" molten metal coming from the nozzle is therefore almost permanently thrown into question.

This is the reason why, according to the invention, on each broad face 22 of the mold, an inductive unit, consisting of a pair of electromagnetic inductors 14, 15, is placed opposite the terminal part of the nozzle. These two inductors are matched so that each produces a magnetic pole facing each other, of opposite sign, so as to create a traversing magnetic field perpendicular to the broad faces 22. As may be seen in FIGS. 1 and 3, this traversing field is located at "M" in the bottom part of the gap so as to "cover" the outlets of type 7 situated at the bottom end of the body of the nozzle 6. However, these inductors are designed so that their magnetic poles can be moved together in the gap. Here, the movement will be vertically along the mold since the conductors 16 . . . 17' lie in the horizontal. This combined movement of the poles of the inductor, over a distance of about 10 or 15 cm, will cause a corresponding movement of the traversing magnetic field in the gap, and hence a correlative modification of the local magnetic conditions in the region of the different outlets 7 and 8 of the nozzle. Consequently there is a desired redistribution of the flows of metal leaving these two types of outlet, the total flow itself remaining unchanged or almost unchanged. Thus, in FIG. 3, M represents an initial bottom position of the magnetic field in the gap and N represents a top final position after vertical movement over a distance "d" in the direction of the outlets 8 delivering upward streams of metal.

The movement of the magnetic field may be obtained by means of a pair of "electromagnet"-type inductors which are therefore provided with a salient magnetic pole, serving as a support for a wire conductor wound around it, and are mounted so as to move translationally along a frame fastened to the casting plant. This construction therefore requires the inductive unit to physically move.

When the prevalent conditions so allow, it will be preferable to opt for a magnetic field that can move in a fixed gap. It is known that such a possibility is provided by an inductive unit, such as that shown schematically in FIG. 2, consisting, opposite each other and on each side of the broad faces 22 of the mold, of two "traveling magnetic field"-type inductors with a plurality of phase windings. The inductor shown here is a flat inductor of the "linear motor stator" type and has two phases (and therefore two phase windings). These conductors are straight copper bars 16, 17, 16', 17', four in number, mutually parallel, spaced apart and laying horizontally. Each winding is composed of two bars linked together in series opposition so that the electric current flows through them in opposite directions. It does not matter whether the linked bars are immediately adjacent bars, such as 17 with 16' and 16 with 17' (inductor with adjacent poles), or are offset, such as 16 with 16' and 17 with 17' (inductor with distributed poles), as shown in the figure.

However, it is important that, whatever the configuration chosen, each phase winding be connected to an individual DC (or rectified) power supply and to this power supply alone and which is independent of that of the other winding. These individual power supplies, shown symbolically at 18 and 19 in FIG. 2, may have, for reasons of convenience, their neutral commoned. They may be integrated into a power supply unit 20 provided with means 21*a* and 21*b* for autonomously adjusting the intensities of the currents delivered by each individual power supply 18, 19 so as to be able, for example, to make a current of maximum intensity flow in one winding while the other is deactivated (zero current), and vice versa, together with all the intermediate adjustments. It is under these conditions that the flat inductor 14 (15) can create, no longer a traveling field, as is ordinarily the case, but a static magnetic field whose magnetic pole which delivers it can be shifted over the active face of the inductor in a direction perpendicular to the conductors, simply by suitably modifying the intensities of the current in the two windings. A more detailed description of this type of inductor and of its traveling-field and static-field modes of operation may moreover be found, if needed, in the PCT international patent application published in the name of the Applicant under No. WO 99/30856.

Figure 3:
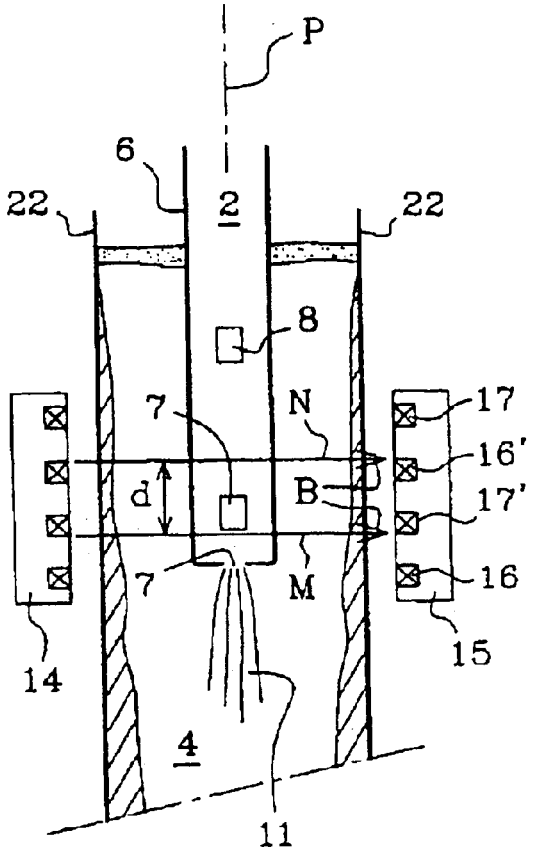
FIG. 3 is a diagram taken from a vertical cross-sectional view in the vertical plane R—R of FIG. 1 and illustrating, seen from the side of the mold, the "traversing field" operating mode of the invention.

In FIG. 3, the bottom position "M" of the magnetic pole corresponds to a maximum current in the winding 16, 16', associated with a zero current in the winding 17, 17'. Conversely, the top position "N" in FIG. 3 corresponds to a maximum current in the winding 17, 17' associated with a zero current in the winding 16, 16'. Of course, it is possible to adjust the location of the pole of the inductor to any level between these two extreme positions by combining the intensities of the currents using the adjusting means 21 with which the power supply 20 is equipped.

Figure 4:
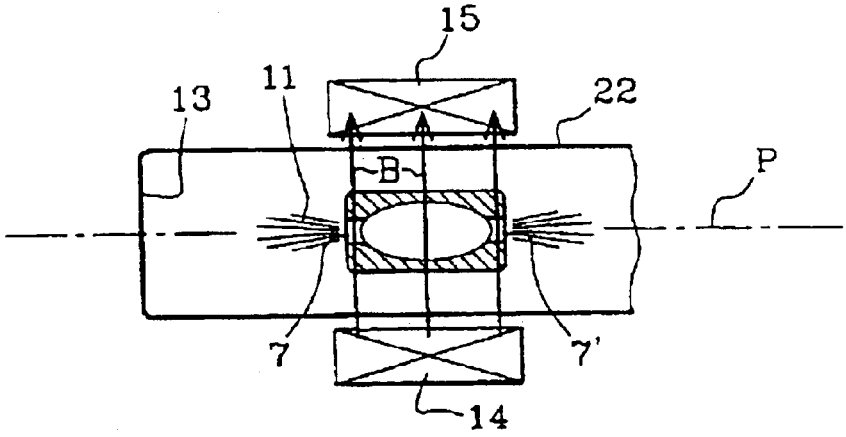
FIG. 4 is a diagram taken from a horizontal cross-sectional view in the horizontal plane Q—Q of FIG. 1 and illustrating, seen along the casting axis, the "traversing field" operating mode of the invention.

It may be clearly seen in FIG. 4 that the two matched flat inductors 14 and 15 are configured so that their respective magnetic poles facing each other have opposite polarities. Consequently, the magnetic field of one is added to the magnetic field of the other at any point in the gap between the two inductors. The configuration is of the "traversing field" type, as illustrated by the arrows B, the lines of force joining the magnetic poles of one inductor to the other by crossing, perpendicularly, the main casting plane P, and therefore the direction of the streams of molten metal leaving the nozzle.

Seen from another angle, this same type of configuration is shown again in FIG. 3. The traversing magnetic field created by the poles of each inductor 14, 15 may be shifted vertically by a distance "d" from a bottom location "M", where the magnetic braking action on the flows from the main outlets 7 is a maximum, to a top location "N" corresponding to a magnetic braking action which is reduced on the main outlets 7 but increased on the secondary outlets 8.

It goes without saying that the invention is not limited to the embodiments exemplified above but extends to many variants or equivalents provided that its definition given in the appended claims is satisfied.

It will be understood that although the nozzle must have outlets in the main casting plane of the mold in order for the invention to be applicable, it may also be provided with other outlets placed elsewhere, for example diagonally in the direction of the corners of the mold. In fact, the more the direction of the outflows becomes orthogonal to the field's lines of force, the more the invention produces its effects, since the effectiveness of the electromagnetic action obtained is directly proportional to the vector product of the magnetic field and the velocity vector of the streams as they leave the outlets of the nozzle.

Figure 6:
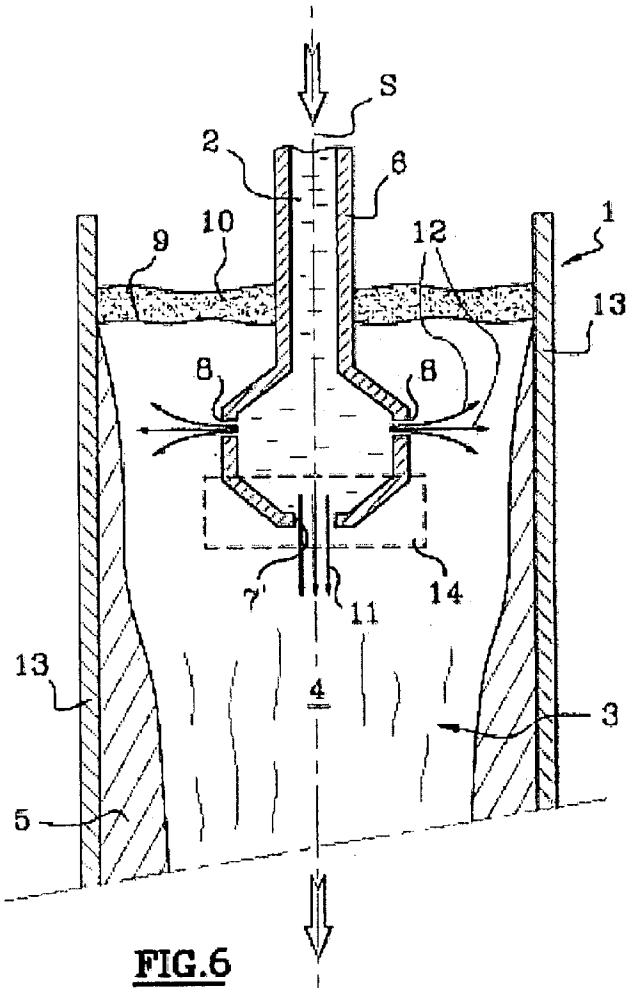
FIG. 6 is another schematic view similar to that of FIG. 1, but illustrating an embodiment of the invention with a nozzle having only one main outlet directed downwardly.

It will have been certainly also understood that, concerning the lower outlets category directed downwardly, the grammatical use of plural employed up to now should not be interpreted in a strict way. Indeed, if the outlets 8 are necessarily at least two so that secondary streams of metal can be directed towards each side face of the mold, this obligation does not exist for the main lower outlets. Those, intended to deliver the principal flow of metal in the direction of casting, can thus be reduced to only one and single outlet. FIG. 6 illustrates such an alternative of realization in which an immersed nozzle 6 of boxing type, having secondary outlets 8 of side exit open toward each side face 13 of the mold, is provided with a principal lower single outlet 7' delivering a metal stream 11 directed downward in the direction of casting. In this case, of course, a single inductor 14 (resp. 15) is monted in front to this low part of the nozzle, preferably on each large face of the mold.

Likewise, although the design of the invention has been mainly motivated with the aim of being able to better manage the heat influx to the free surface from the actual molten metal arriving in the mold and, consequently, has been preferably aimed at nozzles provided with certain outlets directed downward and others directed upward, the invention nevertheless remains of general application to any nozzle whose outlets do not all have the same direction. This is because as soon as two outlets have different, even slightly different, directions, for example differing by only a few degrees in angle, the invention applies in all strictness. However, it applies provided that these two outlets are all the same sufficiently far apart to allow a traversing magnetic field to cover one of them and not the other, or at least to allow it to cover both of them, but with induction values which, at the same moment, are palpably different from one another. Thus, as will doubtlessly have been understood, it is the possibility of having a difference in the intensity of the field between two points in the internal space of a mold for continuously casting products of elongate shape which is the very basis of the original concept of the invention.

Thus, although the invention gives better results in the case of "box"-type nozzles mentioned above, it also applies to straight nozzles, the essential point being that the submerged entry nozzles used for the casting must have different outlets falling within at least two types by the directions—usually upward and downward—that they impose on the streams of molten metal which leave therefrom parallel to the broad faces. In other words, the invention also applies, for example, to straight nozzles having lateral outlets differing by being top and bottom over the shaft of the nozzle.

Moreover, it was implicitly assumed above that the intensity B of the magnetic field remains constant. However, as already indicated, it may very well vary by the intensity of the supply currents being modified, the field itself possibly being moved in the gap at the same time or separately.

Figure 5:
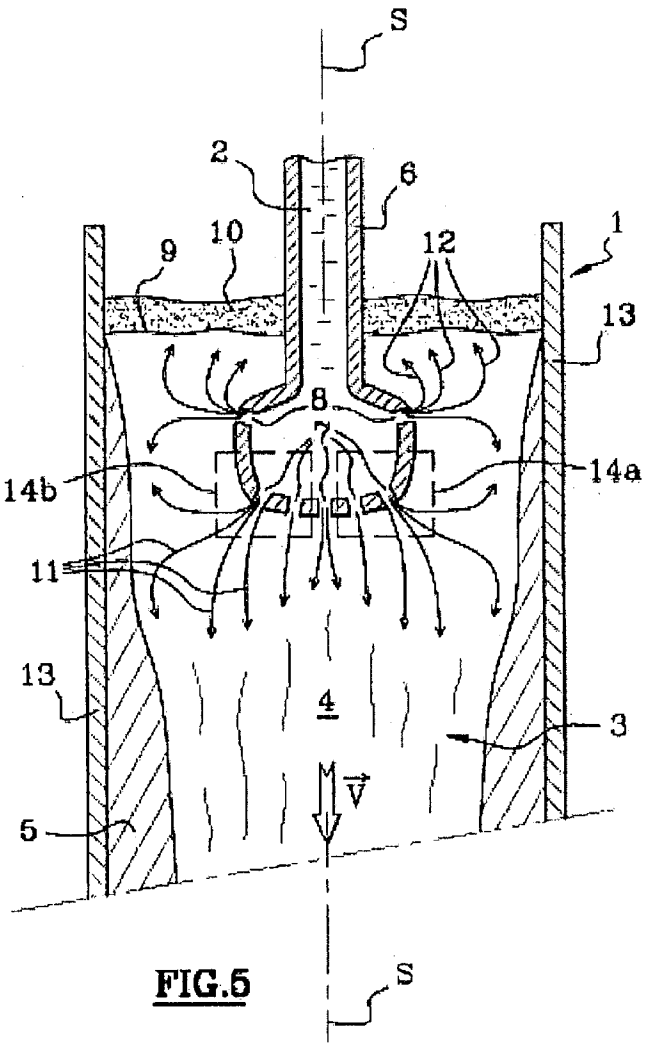
FIG. 5 is a schematic view similar to that of FIG. 1, but illustrating an embodiment of the invention with two inductors side by side per face of the mold.

Likewise, as shown in FIG. 5, the inductor 14 (like the inductor 15 of course) may be divided into two identical parts 14*a* and 14*b* placed side by side on the same face of the mold on each side of the casting axis S on which the casting nozzle is moreover conventionally centered. In this way, the lateral regions of the nozzle are "covered" independently of each other by a magnetic field so as to be able to act selectively on the streams of teemed metal 11, 12 leaving these regions. By autonomously adjusting the inductive parts 14*a* and 14*b*, it is thus possible to further optimize the symmetry of the flows in the mold as they are acted upon at the very moment they leave the nozzle. This result, of course, is obtained as a complement to the primary effect of the invention which remains the distribution between the various nozzle outlets of the total outflow of metal by vertically adjusting the magnetic pole on each inductive part 14*a* and 14*b*. In this version, each inductive part is supplied with current by its own individual power supply (not shown) so as to be able to adjust, as required, the various heights of the magnetic pole on each of them and to separately modify the intensities of the current flowing through them.

Moreover, instead of inductors of the "traveling field" type, it is possible to opt not only for electromagnets, as already mentioned, but also for permanent magnets, either natural or industrial.

Furthermore, the expression "individual DC power supplies" used in the description means not necessarily adding structurally independent individual power supplies but also a single polyphase power supply, having two or three phases and variable frequency, which are set at zero frequency in order to obtain a direct current. Polyphase power supplies of this type are well known. They are of the type comprising an inverter with a variable chopping threshold and are ordinarily used to actuate electric motors having a rotating or traveling magnetic field. The operation of such a power supply to power the windings of the inductor 14, with one phase per winding, consists in adjusting the inverter to the zero frequency, making such adjustments at chosen times so that the intensities of the currents in each phase are, at these times, those that it is desired to obtain in the windings connected to these phases.

The reader is also reminded that although the preferred field of application of the invention is that of the continuous casting of steel slabs, for which it was moreover initially designed, it nevertheless remains applicable to the continuous casting of metals in general and to the continuous casting of thin slabs in particular.

What is claimed is:

1. An apparatus for feeding a mold of a plant for the continuous casting of products of rectangular cross section, with molten metal, which comprises:

a submerged entry nozzle (6) provided with outlets for the molten metal which lie in, or substantially in, the main casting plane (P) parallel to the broad faces of the mold, these outlets differing in their direction of outflow and falling within at least two separate types (7,8);

an inductive unit (14,15) placed over the broad faces of the mold in order to produce thereon magnetic poles of opposite sign facing each other on each side of said main casting plane (P) and delivering, in its gap substantially surrounding the nozzle (6), a traversing magnetic field covering the outlets of at least one (7) of said types (7,8); and means (20,21) for adjusting the relative intensity of said magnetic field, in the region of the outlets of said type (7) which is covered, with respect to the outlets of the other type (8), so as to be able to modify the distribution of the total flow of molten metal between all the outlets of said nozzle (6).

2. The apparatus as claimed in claim 1, wherein said inductive unit is an electromagnetic unit consisting of at least one electromagnet.

3. The apparatus as claimed in claim 1, wherein said inductive unit comprises of inductors (14,15) having a plurality of phase windings of the "traveling field" type, facing each other on each side of said main casting plane (P), and an associated power supply which supplies each of said windings separately with DC current, and wherein the means (20,21) for adjusting the relative intensity of the magnetic field comprise means for moving the location of the magnetic poles in the gap of said electromagnetic unit.

4. The apparatus as claimed in claim 1, wherein said inductive unit comprises of at least one permanent magnet.

5. The apparatus as claimed in claim 2, wherein said means for adjusting the relative intensity of the magnetic field comprise a device for varying the intensity of the electric current supplied to the inductive unit.

6. The apparatus as claimed in claim 2, wherein said means for adjusting the relative intensity of said magnetic field comprise an arrangement in which the magnets or electromagnets can move in a sliding manner.

7. The apparatus as claimed in claim 3, wherein said means for moving the location of the magnetic poles in the gap comprise of means for separately adjusting the intensities of the DC electric currents individually supplying the phase windings of said inductors (14, 15).

8. The apparatus as claimed in claim 1, wherein said inductive unit comprises, on each side of the main casting plane (P), two similar entities **(14*a*, 14*b*)** placed side by side on each side of the casting axis.

9. The apparatus as claimed in claim 1, wherein the submerged entry nozzle is a nozzle provided, in the main casting plane (P), with lower main outlets (7) directed toward the bottom of the mold and with upper secondary outlets (8) directed upward.

10. The apparatus as claimed in claim 9, wherein the lower main outlets form one and the same outlet.

11. The apparatus as claimed in claim 1, wherein the submerged entry nozzle is a nozzle provided, in the main casting plane (P) with a single individual lower outlet directed toward the bottom of the mold.

* * * * *